US005293525A

United States Patent [19]

Yoshimura

[11] Patent Number: 5,293,525

[45] Date of Patent: Mar. 8, 1994

[54] STRUCTURE FOR VARIABLE ELECTRONIC COMPONENT

[75] Inventor: Tamotsu Yoshimura, Kyoto, Japan

[73] Assignee: Rohm Co., Ltd., Kyoto, Japan

[21] Appl. No.: 12,455

[22] Filed: Feb. 2, 1993

[30] Foreign Application Priority Data

Feb. 28, 1992 [JP] Japan ..... 4-043255

[51] Int. Cl.[5] ..... H01C 10/32

[52] U.S. Cl. ..... 338/162; 338/163

[58] Field of Search ..... 338/162, 163, 170, 171, 338/172, 173, 174; 361/287, 298

[56] References Cited

U.S. PATENT DOCUMENTS 3,581,265 5/1971 Falco ..... 338/174
4,712,084 12/1987 Okazaki et al. ..... 338/163 X
4,785,278 11/1988 Nishzawa et al. ..... 338/162
4,977,387 12/1990 Molia ..... 338/174
4,998,088 3/1991 Masuda ..... 338/162

FOREIGN PATENT DOCUMENTS 3-85604 8/1991 Japan .

*Primary Examiner*—Marvin M. Lateef
*Attorney, Agent, or Firm*—William H. Eilberg

[57] ABSTRACT

A variable electronic component has a substrate and a rotor rotatably supported on the substrate for parameter adjustment of the electronic component. The rotor has an opening and a plurality of engaging slots extending from the opening for engagement with a turning tool. Each of the engaging slots is flanked by a pair of tool guides which are inclined downwardly toward the engaging slot.

10 Claims, 5 Drawing Sheets

STRUCTURE FOR VARIABLE ELECTRONIC COMPONENT

BACKGROUND OF THE INVENTION

1. Field of the Invention

This invention relates to a structure for a variable electronic component, such as variable resistor or variable capacitor, wherein a certain parameter or physical property of the component is adjusted by rotating a rotor relative to a substrate.

2. Description of the Prior Art

A variable resistor of the above-described type is disclosed in Japanese Utility Model Application Laid-open No. 3-85604 (Laid-open: Aug. 29, 1991) of the same applicant. The resistor comprises an insulating substrate formed with a resistor strip, and a rotor rotatably supported on the substrate. The rotor has a contact portion in pressing and sliding contact with the resistor strip, so that the resistance of the resistor is adjustable by turning the rotor relative to the substrate.

The rotor of the prior art variable resistor is formed with a plurality of engaging slots for engagement with a turning tool, such as a driver, which is incorporated in an automatic adjusting apparatus. After mounting the resistor at a suitable portion of a printed circuit board, the driver of the automatic adjusting apparatus is axially aligned with the rotational center of the rotor. Then, the driver is lowered for engagement with the engaging slots to enable rotation of the rotor for resistance adjustment.

However, if the driver is not properly positioned rotationally, it is impossible to bring the driver into complete engagement with the engaging slots of the rotor. Thus, the rotational position of the driver must be finely adjusted before actually turning the rotor, consequently resulting in a deterioration of the efficiency in automatic resistance adjustment.

SUMMARY OF THE INVENTION

It is, therefore, an object of the present invention to provide a variable electronic component, such as variable resistor or variable capacitor, which facilitates parameter adjustment by a turning tool.

Another object of the present invention is to provide a variable electronic component which, while achieving the above-described object, incorporates a rotor made of a thin metallic sheet.

According to the present invention, there is provided a variable electronic component comprising: a substrate; and a rotor rotatably supported on the substrate for parameter adjustment of the electronic component, the rotor having an opening and a plurality of engaging slots extending from the opening for engagement with a turning tool from one side of the opening; wherein each of the engaging slots is flanked by a pair of tool guides which are inclined toward said each engaging slot in a direction away from said one side of the opening.

In one preferred embodiment, the rotor is made of a thin metallic sheet, and includes a cup member and an upper plate member. The cup member has an outer flange portion. The upper plate member is integrally connected to the cup member and folded over the flange portion of the cup member. The upper plate member is made to have all of the opening, the engaging slots and the tool guides.

In another preferred embodiment, the rotor includes only a cup member made of a thin metallic sheet and having an outer flange portion which defines an opening. The outer flange portion is made to have the engaging slots and the tool guides.

Other objects, features and advantages of the present invention will be fully understood from the following detailed description given with reference to the accompanying drawings.

DETAILED DESCRIPTION OF THE PREFERRED EMBODIMENTS

Figure 1:
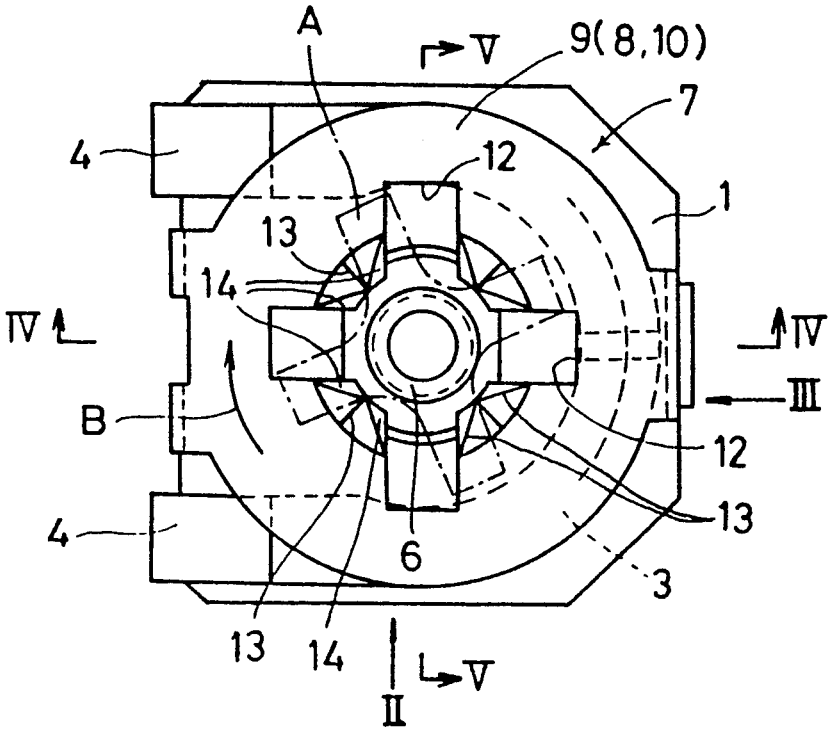
FIG. 1 is a plan view showing a variable resistor according to the present invention.

FIGS. 1 through 9 illustrate a first embodiment of the present invention as applied to a variable resistor. However, the present invention may be also applied to a variable capacitor or any other electronic component which requires adjustment of a certain parameter by rotation of a rotor.

The variable resistor according to the first embodiment comprises an insulating substrate 1 made of a ceramic material for example. The substrate 1 has a central bore 2 (see FIGS. 4 and 5), and carries a U-shaped resistor strip 3 formed on the upper surface of the substrate to partially surround the central bore 2 (see FIGS. 1, 4 and 5). Each end of the resistor strip 3 is electrically connected to a first terminal member 4 arranged at one side of the substrate 1.

The underside of the substrate 1 carries a second terminal member 5. This terminal member is integrally formed with a cylindrical support shaft portion 6 fitted in the central bore 2 of the substrate 1 (see FIGS. 4 and 5).

Figure 2:
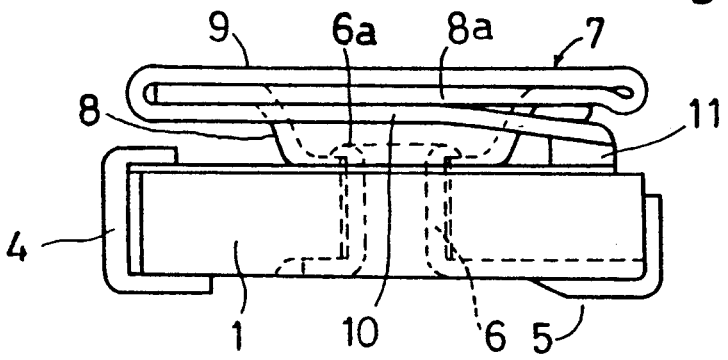
FIG. 2 is an elevational view of the same resistor as seen in the direction of an arrow II in FIG. 1.
Figure 3:
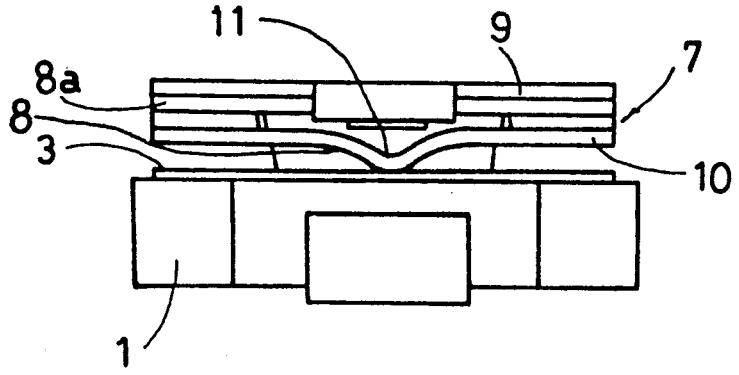
FIG. 3 is an elevational view of the same resistor as seen in the direction of an arrow III in FIG. 1.
Figure 4:
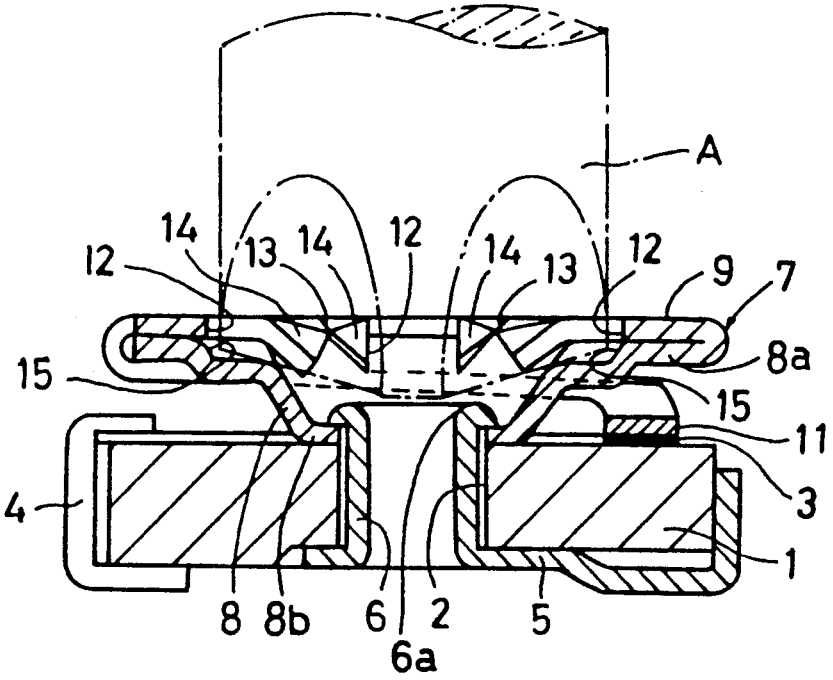
FIG. 4 is a sectional view taken along lines IV—IV in FIG. 1.
Figure 5:
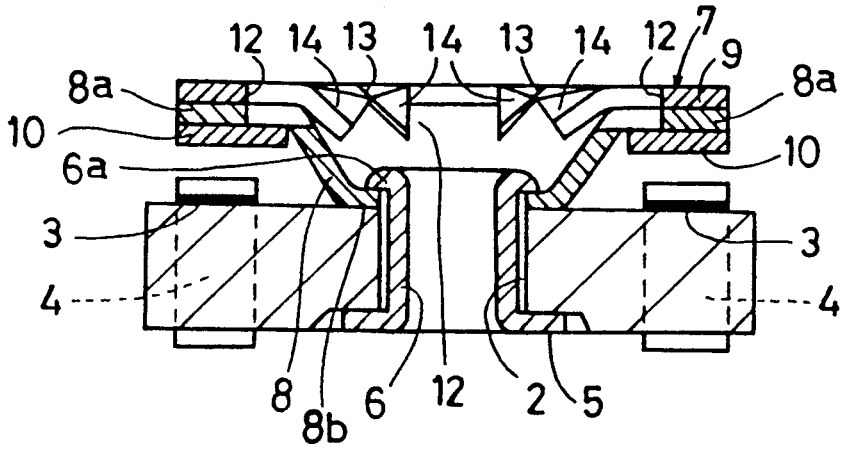
FIG. 5 is a sectional view taken on lines V—V in FIG. 1.
Figure 6:
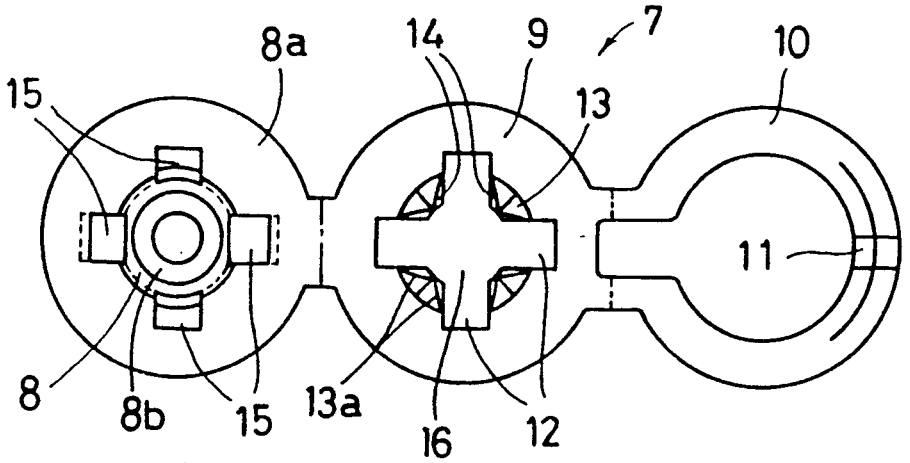
FIG. 6 is an expanded plan view showing a rotor incorporated in the same resistor.
Figure 7:
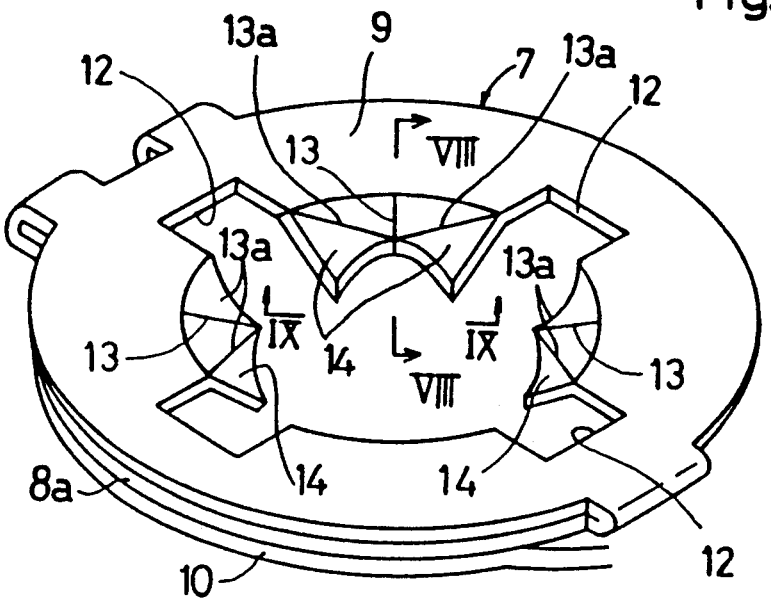
FIG. 7 is a perspective view showing the rotor in an assembled state FIG. 6.
Figure 8:
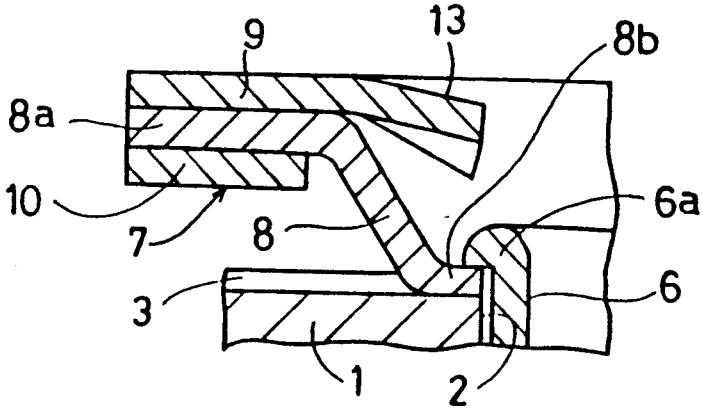
FIG. 8 is an enlarged fragmentary sectional view taken along lines VIII—VIII in FIG. 7.
Figure 9:
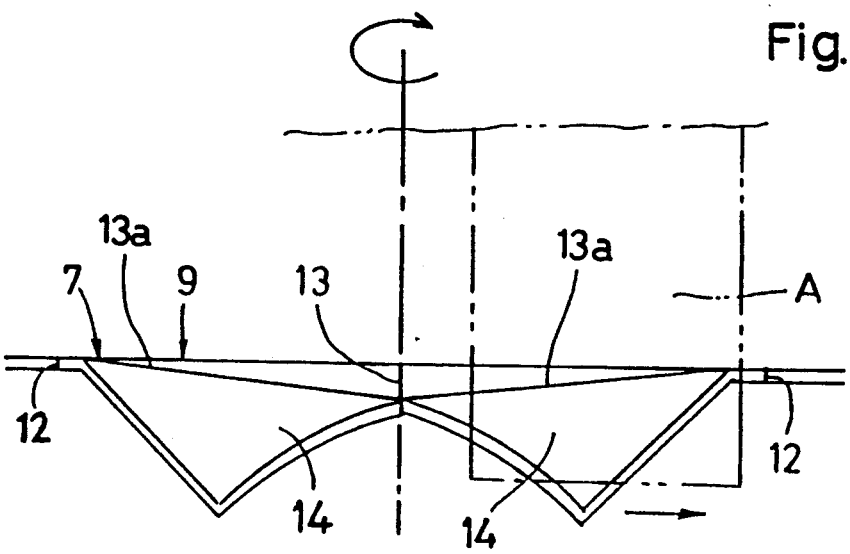
FIG. 9 is an enlarged fragmentary view of the rotor as seen in the direction of arrows IX—IX in FIG. 7.

The variable resistor further comprises a rotor 7 which includes a cup or dish member 8, an upper plate member 9, and a lower ring member 10. The rotor 7 having these three members is formed of a punched thin metallic plate which is initially in an expanded state (FIG. 6) and later folded by bending at the respective connections between the three members 8-10. Specifically, as shown in FIGS. 2, 4 and 7, the upper plate member 9 is folded over the cup member 8, whereas the lower ring member 10 is folded under the cup member 8.

The cup member 8, which is centrally recessed in the form of a shallow cup or dish, has an outer flange portion 8*a* and an inner marginal portion 8*b*. The inner marginal portion 8*b* is fitted around the shaft portion 6 of the second terminal member 5, and the shaft portion 6 is made to have an upper end 6*a* which is enlarged by calking (plastic deformation) for slidable engagement with the inner marginal portion 8*a*. Thus, the rotor 7 is rotatably supported by the shaft portion 6 of the second terminal member 5.

The upper plate member 9 of the rotor 7 rests on the outer flange portion 8*a* of the cup member 8. The upper plate member 9 has an central opening 16 (see FIG. 6) and a plurality of engaging slots 12 extending radially from the central opening in a cross arrangement for engagement with a Phillips head driver A (see FIGS. 1 and 4).

As shown in FIGS. 4–7 and 9, each of the engaging slots 12 is flanked a pair of driver guides 14 which are inclined downwardly (into the cup member 8) toward the slot 12. In the illustrated embodiment, each driver guide 14 is bounded at an intermediate ridgeline 13 by a similar driver guide associated with an adjacent engaging slot. The ridgeline 13 itself may be gently inclined downwardly in a radially inward direction, and the driver guide 14 may be made to increase abruptly in inclination angle at a bending line 13*a*.

The lower ring member 10 is made to fit on the cup member 8 from below by bending at the connection between the upper plate member 9 and the ring member 10. The ring member has a downwardly projecting contact portion 11 which is held in pressing contact with the resistor strip 3 under the elastic urging force of the ring member itself.

Preferably, the outer flange portion 8*a* of the cup member 8 is formed with recesses 15 in corresponding relation to the respective engaging slots 12 of the upper plate member 9. These recesses enable the driver head A (FIGS. 1 and 4) to engage more deeply in the slots 12.

With the arrangement described above, the resistance of the variable resistor can be adjusted by turning the rotor 7 on the shaft portion 6 of the second terminal member 5 to change the position of the contact portion 11 relative to the resistor strip 3. The adjusted resistance is given across one of the first terminal members 4 and the second terminal member 5.

For turning the rotor 7, the drive head A (FIGS. 1 and 4) need be brought into complete engagement with the engaging slots 12 of the upper plate member 9. At this time, the inclined driver guides 14 serve to forcibly turn the driver head A in downward movement (see the arrow B in FIG. 1) even if the driver head is initially out of proper rotational position relative to the engaging slots 12. Thus, the driver guides 14 provide automatic engagement of the drive head A with the rotor 7, thereby facilitating resistance adjustment.

Figure 10:
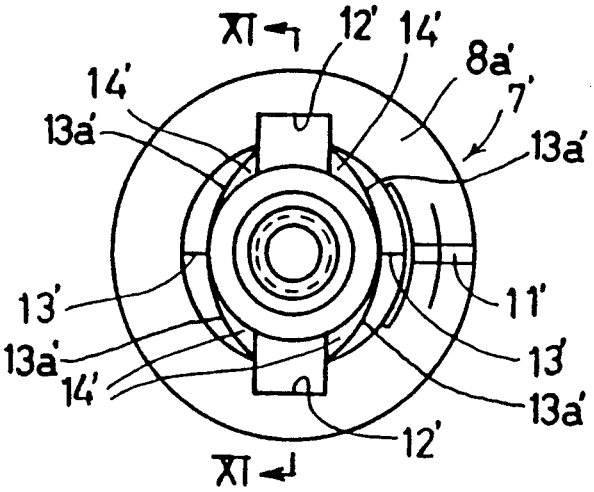
FIG. 10 is a plan view showing another variable resistor according to the present invention.
Figure 11:
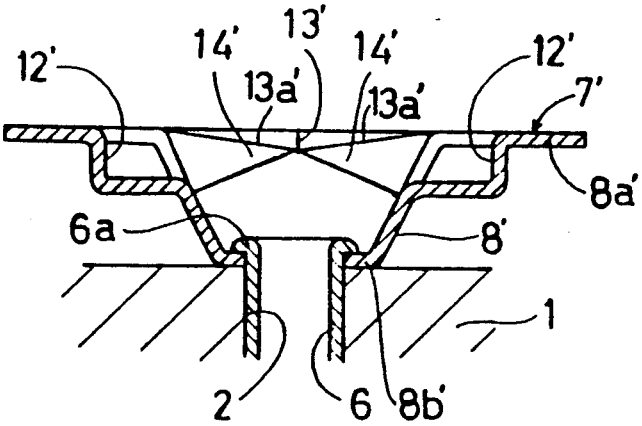
FIG. 11 is a sectional view taken along lines XI—XI in FIG. 10.

FIGS. 10 and 11 shown a variable resistor according to a second embodiment of the present invention. The resistor of this embodiment differs from that of the first embodiment only in the incorporation of a modified rotor 7'.

Specifically, the modified rotor 7' consists only of a cup member 8' having an outer flange portion 8*a*' and an inner marginal portion 8*b*'. The cup member 8' has a pair of engaging slots 12' extending radially outward from a central opening (not numbered) of the cup member for engagement with a key head driver (not shown). Further, the flange portion 8*a*' of the cup member 8' is formed, at a suitable circumferential position, with a downwardly projecting contact portion 11'.

Similarly to the first embodiment, each of the engaging slots 12' is flanked by a pair of driver guides 14' which are inclined downwardly (deeper into the cup member) toward the guide slot. Each driver guide 14' is bounded at an intermediate ridgeline 13' by a similar driver guide associated with the other engaging slot. The ridgeline 13' itself may be gently inclined downwardly in a radially inward direction, and the driver guide 14' may be made to increase abruptly in inclination angle at a bending line 13*a*'.

Obviously, due to the provision of the inclined guides 14', the second embodiment enjoys the same advantage as the first embodiment.

The present invention being thus described, it is obvious that the same may be varied in many ways. Such variations are not to be regarded as a departure from the spirit and scope of the invention, and all such modifications as would be obvious to those skilled in the art are intended to be included within the scope of the following claims.

I claim:

1. A variable electronic component comprising:

a substrate; and a rotor rotatably supported on the substrate for parameter adjustment of the electronic component, the rotor having an opening and a plurality of engaging slots extending from the opening for engagement with a turning tool from one side of the opening;

wherein each of the engaging slots is flanked by a pair of tool guides which are inclined toward said each engaging slot in a direction away from said one side of the opening.

2. The electronic component according to claim 1, wherein each of the tool guides increases abruptly in inclination angle at a bending line.

3. The electronic component according to claim 1, wherein each of the tool guides extends from an intermediate ridgeline formed between two adjacent engaging slots to extend toward the opening.

4. The electronic component according to claim 3, wherein the ridgeline is inclined toward the opening in a direction away from said one side of the opening.

5. The electronic component according to claim 1, wherein the engaging slots are formed in a cross arrangement.

6. The electronic component according to claim 1, wherein the engaging slots are formed in a single line arrangement.

7. The electronic component according to claim 1, wherein the rotor is made of a thin metallic sheet, the rotor including a cup member and an upper plate member, the cup member having an outer flange portion, the upper plate member being integrally connected to the cup member and folded over the flange portion of the cup member, the upper plate member being made to have all of the opening, the engaging slots and the tool guides.

8. The electronic component according to claim 7, wherein the flange portion of the cup member is formed with recesses in corresponding relation to the engaging slots.

9. The electronic component according to claim 7, wherein the rotor further includes a ring member integrally connected to the upper plate member and folded under the cup member.

10. The electronic component according to claim 1, wherein the rotor includes a cup member made of a thin metallic sheet and having an outer flange portion which defines an opening, the outer flange portion being made to have the engaging slots and the tool guides.

* * * * *